US006149516A

United States Patent [19]

Mantyla

[11] Patent Number: 6,149,516

[45] Date of Patent: Nov. 21, 2000

[54] SOFFIT VENT APPARATUS

[75] Inventor: James Mantyla, Barrie, Canada

[73] Assignee: Canplas Industries, Ltd., Barrie, Canada

[21] Appl. No.: 09/350,673

[22] Filed: Jul. 9, 1999

[51] Int. Cl.[7] ..... F24F 7/007

[52] U.S. Cl. ..... 454/359; 454/367; 454/349

[58] Field of Search ..... 454/347, 349, 454/353, 358, 359, 360, 363, 367

[56] References Cited

U.S. PATENT DOCUMENTS

| | | | |
|---|---|---|---|
| 621,551 | 3/1899 | Wörz . | |
| 1,792,585 | 2/1931 | Hertel | 454/360 |
| 2,218,348 | 10/1940 | Boyer . | |
| 2,334,789 | 11/1943 | Olson . | |
| 3,018,713 | 1/1962 | Anderson . | |
| 4,151,789 | 5/1979 | Grobard . | |
| 5,167,578 | 12/1992 | Legault | 454/359 X |
| 5,259,411 | 11/1993 | Guzorek . | |
| 5,498,204 | 3/1996 | Anderson et al. | 454/359 |
| 5,692,955 | 12/1997 | Meyer | 454/359 X |
| 5,711,091 | 1/1998 | Bos | 454/353 X |
| 5,722,181 | 3/1998 | Meyer . | |
| 5,762,551 | 6/1998 | Lachapelle et al. | 454/359 |
| 5,791,985 | 8/1998 | Schiedegger et al. . | |

*Primary Examiner*—Harold Joyce
*Attorney, Agent, or Firm*—Hoffmann & Baron, LLP

[57] ABSTRACT

A soffit vent apparatus for venting gases from an enclosure to the external environment, comprising a cover comprising an air-permeable portion and a mounting flange, the cover being mountable to a soffit; a duct mountable to the cover in communication with the air-permeable portion and operatively coupleable to the enclosure; and a valve mounted in the duct. The valve allows gases under pressure to flow through the duct and the air-permeable portion to the external environment.

26 Claims, 7 Drawing Sheets

SOFFIT VENT APPARATUS

FIELD OF THE INVENTION

This invention relates to the field of vents, and more particularly to the field of soffit vents.

BACKGROUND OF THE INVENTION

Virtually all buildings and enclosures where human activity takes place require venting of one type or another. The type of venting device employed will depend upon the kind of enclosure to be vented. For example, bathrooms containing showers typically have active vents with fans to vent steam to the outdoors. Kitchens, particularly in restaurants and hotels, similarly have powered vents for removing smoke and steam to the outdoors. By contrast, other types of enclosures, such as attics, do not require active venting.

In previous years, building codes in various jurisdictions frequently allowed for the venting of bathroom and kitchen gases to the attic of a building, which gases would then be vented to the outdoors through an attic vent. However, in recent years, many building codes have begun to require that such gases be actively vented directly to the outdoors through a dedicated vent. Typically, such gases would be actively vented into a conduit, which conduit is operatively connected to a vent duct. The vent duct is in turn connected to the exhaust outlet of the vent. The size of the conduit will vary according to the source of the vented gases. For example, dryer conduits are typically 5-inch diameter hoses. By contrast, bathroom conduits are typically 4-inch diameter hoses.

The desired location of the exhaust outlet of such a vent will depend on the location of the room being actively vented. Under some circumstances, it may be convenient or even necessary for the exhaust outlet to be located on the soffit of the building, that is, a substantially horizontal surface located underneath a roof overhang. It is often desirable to have the exhaust outlet on a soffit, because doing so is more cost effective than having to make a hole in a roof or wall for mounting an exhaust outlet.

In order to conserve energy, it is desirable to construct the vent so that cold air from the outdoors may not flow into the building through the exhaust outlet of the vent. While such back flow could not take place while air is being forcibly exhausted out through the vent, most active vents only operate intermittently, and back flow is possible when they are off.

A variety of venting devices are currently known. For example, U.S. Pat. No. 5,791,985 issued to Schiedegger et al. discloses a modular soffit vent including a rectangular base member having a planar securing flange and a large circular opening. Welded to the base member is a length of vent duct communicating with the circular opening. The vent duct has an adapter which allows for the attachment of different-sized conduits. A circular air-permeable screen fits into the circular opening, and a cage-like cover fits over the entire rectangular base member, thus preventing debris, animals and the like from entering the vent.

This device suffers from the problem of being complex to install in a soffit because it comprises many separate external pieces such as the cover, base member and screen. Also, the duct is rigidly connected to the base member. Therefore, if the base member requires replacement, the duct must be replaced as well, thus increasing replacement costs. Since the base member is mounted on the exterior of the building, it is likely to corrode or decay faster than the duct, and would therefore likely require replacement more often. Finally, this device does not address the problem of back flow of air through the vent.

U.S. Pat. No. 5,167,578 discloses a soffit vent which includes an air inlet in a room to be vented, communicating through a duct to a housing having an air flow passage, the housing being mounted on the external side of a soffit. The housing includes a flange for mounting the housing on the soffit. Mounted within the housing on the external side of the flange is a flap valve which is normally closed by gravity. When air flow through the vent is commenced by the operation of a power-driven unit in the interior of the building, the flap valve is lifted by the air flow, allowing the vented air to be exhausted. When the power-driven air flow ceases, the flap valve falls closed, thus preventing external air from flowing back into the building. The flap valve disclosed in this patent is hinged at its upper edge, and hangs closed when air flow is absent. Because of the structure of this device, the flapper valve must be mounted outside of the soffit in a position where the air flow past the valve is substantially horizontal. Since the soffit itself is typically substantially horizontal, the housing must protrude from the soffit in order for the vent to operate. The result is a vent which, when installed, must protrude in an unsightly fashion from the soffit. Furthermore, the housing may be difficult and expensive to manufacture, because of the relatively complex three-dimensional shape that the housing must take on in order to carry the flap valve in the appropriate position.

U.S. Pat. No. 5,722,181 discloses an exhaust vent. The device includes an air exit aperture and a vent frame adapted to establish communication with the air exit aperture, and a plurality of flow control louvers mounted so as to permit exiting air flow while blocking back flow. The device also includes a hood and cage mounted outside the louvers. The louvers are hinged at their top ends so as to be hanging vertically when air flow is present, and pushed open toward a horizontal position when air is exhausted through the vent. Each of the louvers hangs by its upper edge, and the louvers are mounted outside the vent frame on the exterior of the building.

As a result of this structure, the device is not suitable for use on a horizontal soffit, as the louvers would hang open even when no air is being exhausted through the vent. Also, the device disclosed would necessarily produce an unsightly protrusion from the soffit by virtue of the hood and cage mounted on the outside of the louvers.

U.S. Pat. Nos. 2,344,789; 2,218,348; and 4,151,789 also disclose venting devices have flap-style valves to prevent back flow from the external environment, but, for similar reasons, none of these devices is suitable for mounting on a soffit.

SUMMARY OF THE INVENTION

Therefore, what is desired is a soffit vent apparatus which is simple to manufacture and install, and can be mounted on a soffit without requiring an unsightly protrusion from the soffit while still preventing back flow of external air into the vent duct. Preferably, the apparatus will include an adapter for attaching different-sized conduits.

Accordingly, the present invention is directed to a soffit vent apparatus for venting gases from an enclosure to the external environment. The apparatus comprises a cover including an air-permeable portion and a mounting flange, the cover being mountable to a soffit. The apparatus further comprises a duct mountable on the cover in communication with the air-permeable portion, and operatively coupleable to the enclosure. The apparatus still further comprising a valve mounted in the duct. The valve allows gases under pressure to flow through the duct and the air-permeable portion to the external environment.

In another aspect of the present invention, the apparatus will also comprise conduit size adaption means whereby the duct may be adapted to operatively communicate with different conduits having a plurality of different diameters. In still another aspect of the invention, the conduit size adaption means comprises an upstream section of the duct which is of smaller cross-sectional area than the downstream section of the duct.

In still another aspect of the present invention, the duct will be releasably and snappably mountable on the cover. This allows the cover of an already installed soffit vent apparatus to be replaced without having to replace the duct or the valve.

BRIEF DESCRIPTION OF THE DRAWINGS

Reference will now be made by way of example only to drawings of the present invention which illustrate the preferred embodiment of the invention, and in which.

DETAILED DESCRIPTION OF THE PREFERRED EMBODIMENTS

Figure 1:
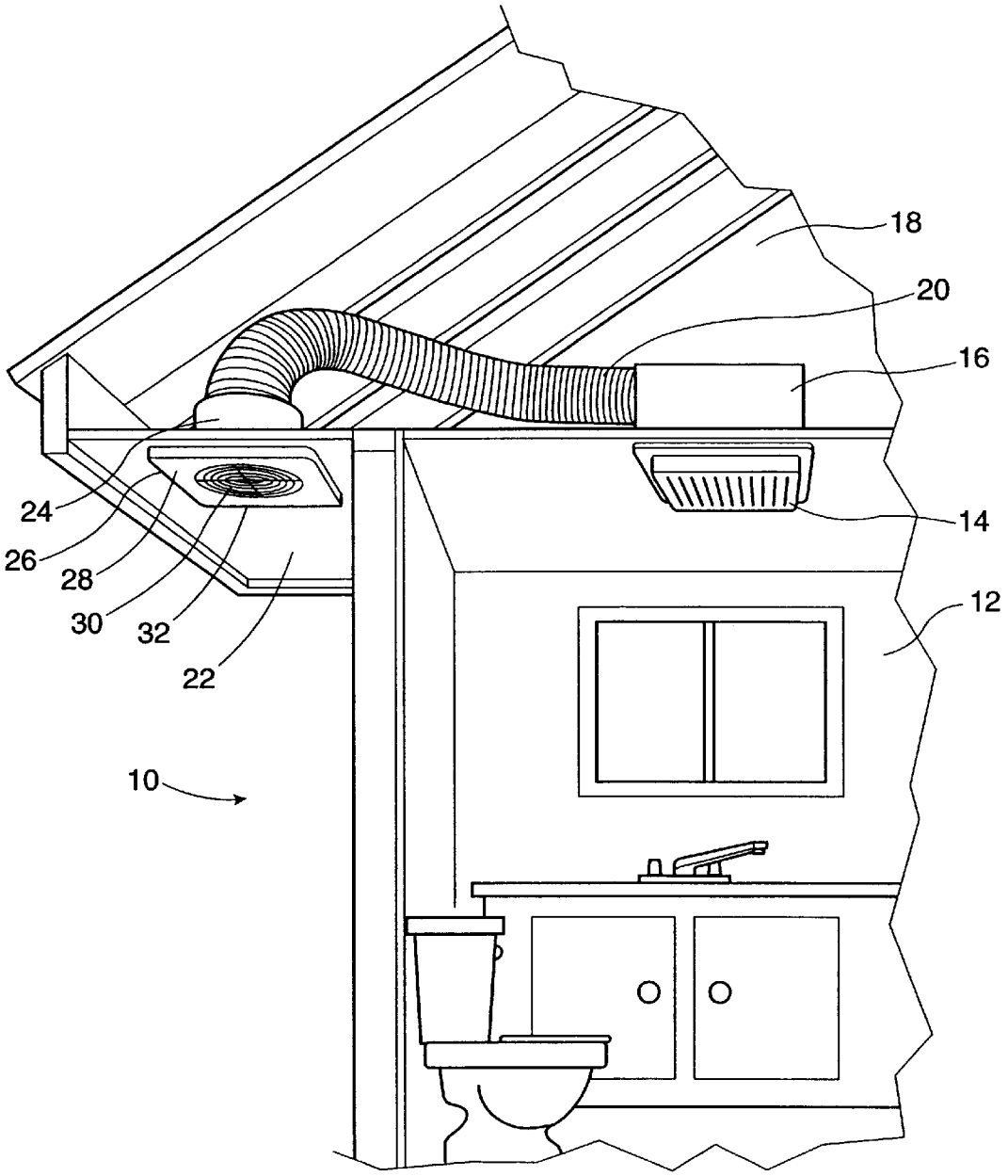
FIG. 1 is a cross-sectional view of a bathroom, attic and soffit vent apparatus of the present invention.

FIG. 1 shows a typical house 10 having a bathroom 12. The bathroom 12 contains a vent inlet 14 which is in communication with a vent fan 16 in the ceiling of the bathroom 12. Above the ceiling of the bathroom 12 is an attic 18. Within the attic 18 is a gas conduit 20 in communication with the vent fan 16. The gas conduit is attached to the soffit vent apparatus for venting gases from the enclosure to the external environment. The soffit vent apparatus comprises a duct 24 which is mounted on a vent cover 26. In the preferred embodiment shown, the cover 26 has an exterior side 28 and interior side 38 (shown in FIG. 2), and the duct is mounted on the interior side 38. The cover 26 is mounted to the soffit 22 against its interior side 38. However, it will be appreciated by those skilled in the art that the cover 26 could also be mounted inside of the soffit and have a projection through and flush with the soffit, for the passage of air or the like. The external placement of the cover 26 is preferred however, to hide the edge cut of the opening through the soffit.

The cover 26 includes an air-permeable portion in the form of a central grill 30, and a mounting flange 32. The duct 24 is mounted on the interior side 38 so as to be in communication with the central grill 30, so that air may flow efficiently through the duct 24 and the central grill 30 into the external environment.

The cover 26 is preferably rectangular, providing a narrow dimension to accommodate narrow soffits.

Also, the duct 24 is preferably short in height so as to accommodate situations where the clearance between the soffit and the roof is small. Such a situation may arise, for example, when the soffit is particularly narrow, or the roofs angle from the horizontal is small. The duct is preferably less than 10" tall, more preferably less then 6" tall and most preferably about 5½" in height from the interior side 38.

Figure 2:
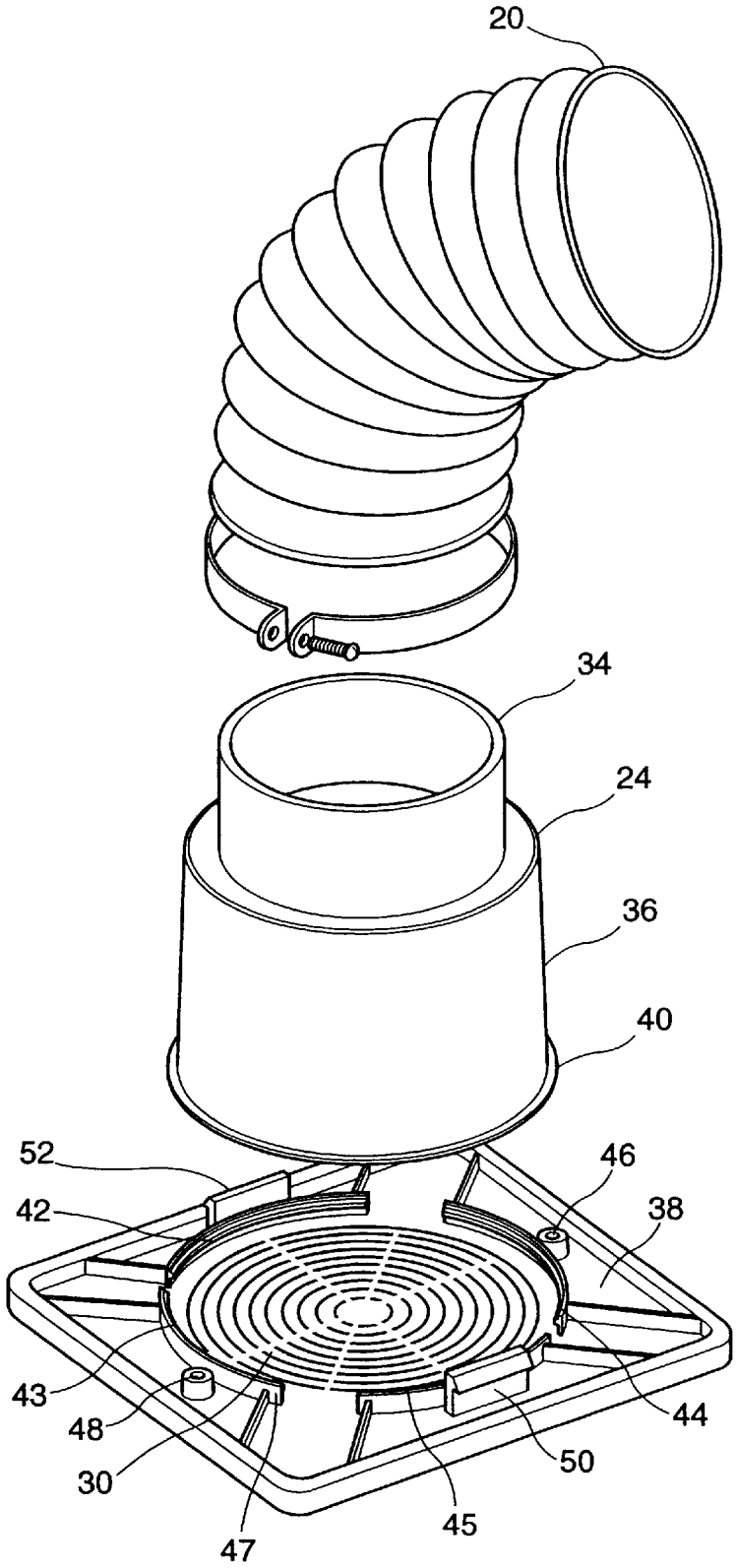
FIG. 2 is a perspective exploded view of the soffit vent apparatus and a gas conduit attachable thereto.

Referring now to FIG. 2, the duct 24, preferably being substantially circular in cross-section, preferably comprises a cylindrical upstream section 34 and a cylindrical downstream section 36 connected coaxially and operatively. Most preferably the duct is slightly conical (a narrowing taper towards the top) to aid both in removing the part from the tooling and to permit a tight fit for dryer vent and conduit applied over the exterior of the duct. The soffit vent apparatus preferably includes a conduit size adaption means for allowing the duct to communicate with gas conduits of differing sizes. The conduit size adaption means may be anything that allows the apparatus to be attached to at least two differently-sized conduits. Preferably, the conduit size adaption means comprises the upstream section 34 and the downstream section 36 in combination. In the most preferred embodiment the upstream section 34 is 4-inches in diameter, and the downstream section 36 is 5-inches in diameter. Thus, the duct may be fitted with a typical dryer vent conduit which is 5-inches in diameter, or with a typical bathroom vent conduit which is 4-inches in diameter. If attachment to a 4-inch conduit is desired, the duct 24 is used as provided. If attachment to a 5-inch conduit is desired, the upstream section 34 can be cut off quickly with a knife immediately prior to installation and discarded.

The downstream end of the downstream section 36 includes a lip 40 which fits into lip clamps 42, 43, 44 and 45 carried on the inner circumference of the circular duct holder 47 protruding from the interior side 38. The lip clamps 42, 43, 44 and 45 are positioned such that when lip 40 is pressed downward toward the interior side 38, the lip 40 snaps under and is held by the lip clamps 42, 43, 44 and 45.

The cover 26 further comprises wooden-soffit-mounting means, which are preferably in the form of screw holes 46, 48. The screw holes 46, 48 are used in combination with wood screws 54, 56 (FIG. 4) to fasten the apparatus to a wooden soffit. The cover 26 also comprises plastic-or-metal-soffit-mounting means, preferably in the form of clasps 50, 52 located on the outward face of the releasable lip clamps 42, 44. When pressed against an appropriately-sized aperture in a metal or plastic soffit, the clasps flex slightly inwardly and then snap over the edge of the aperture, thus mounting the cover 26 onto the soffit.

Figure 3B:
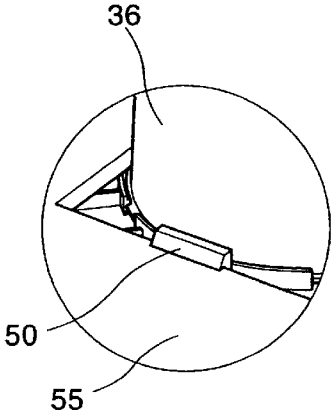
FIG. 3B is a close-up view of the circled portion of FIG. 3A.
Figure 3A:
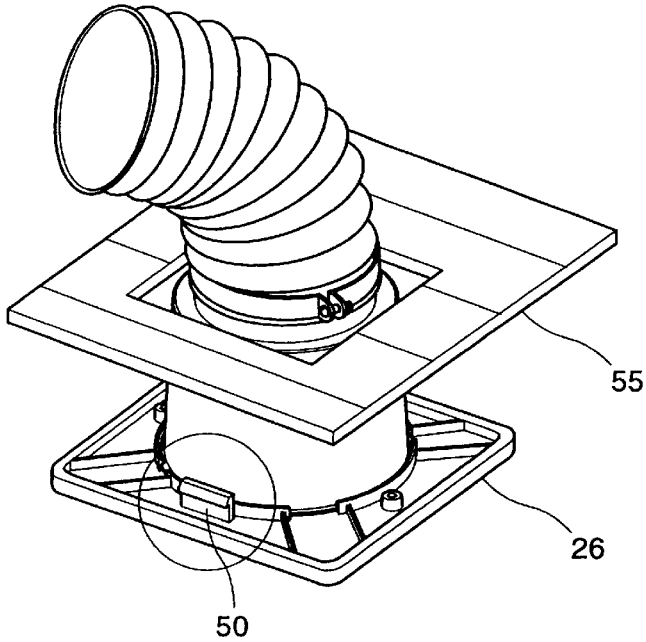
FIG. 3A is a perspective view of the soffit vent apparatus mounted on a metal or plastic soffit.

FIG. 3B provides a close-up view of the clasp 50 operating to mount the cover 26 on a metal or plastic soffit 55.

Figure 4:
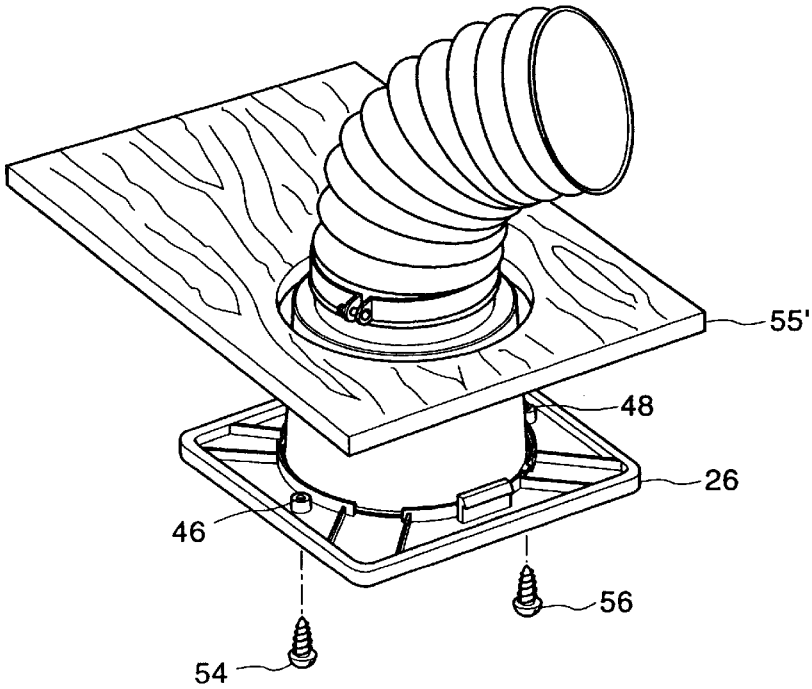
FIG. 4 is a perspective view of the soffit vent apparatus to be mounted on a wooden soffit.

FIG. 4 shows the operation of wood screws 54, 56 in combination with screw holes 46, 48 to mount the cover 26 onto a wooden soffit 55'. It will be appreciated by those skilled in the art that there are many types of fasteners that might be used to fasten the cover to metal and wood soffits. The ones described above and illustrated are provided by way of preferred example only, and other means, such as nails, glue and other mechanical fasteners can also be used.

Figure 5:
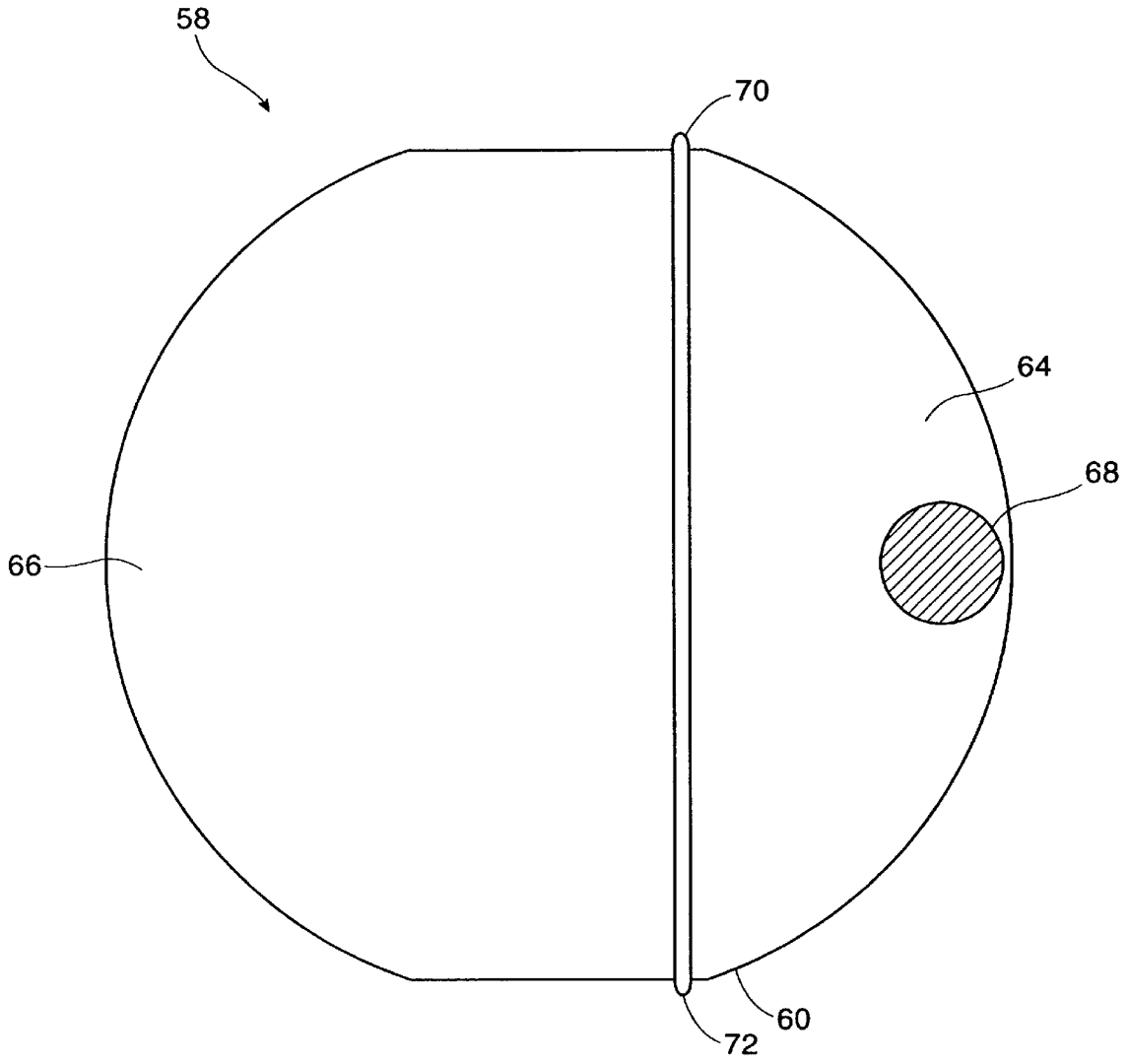
FIG. 5 is a plan view of the valve mounted on the duct of the soffit vent apparatus.
Figure 6:
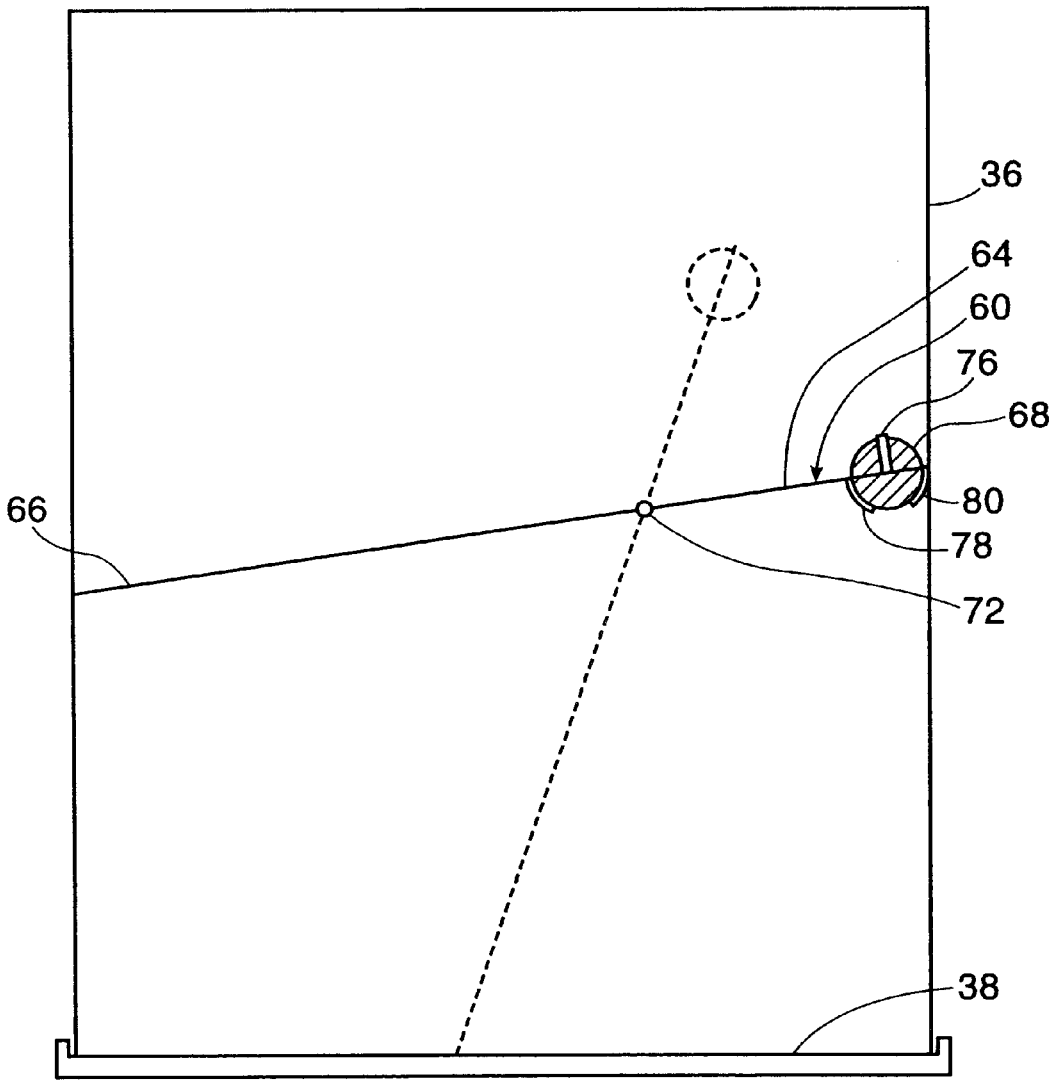
FIG. 6 is a cross-sectional view of the soffit vent apparatus, showing the valve in its open and closed positions.

Referring now to FIG. 5, the valve 58 is shown. The valve 58 is pivotally mounted in the downstream section 36 upstream from the interior side 38 (as shown in FIG. 6). The valve 58 may be in any form wherein it allows gases under pressure to flow through the duct 24 to the external environment and prevent gases from the external environment from flowing through the duct 24.

Preferably, the valve 58 comprises a valve barrier, which is most preferably in the form of a substantially elliptical plate 60 having short arm 64 on one side of the pivot axis of the plate 60 and a long arm 66 on the other side of the pivot axis of the plate 60. The plate 60 is pivotally mounted in downstream section 36. The short arm 64 has a counterweight 68 mounted thereon, the function of which counterweight is described in more detail below.

The plate 60 preferably further comprises pivot pins 70 and 72 extending laterally from the plate 60. The plate 60 is mounted in the downstream section 36 by placing the pivot pins 70 and 72 into correspondingly positioned pivot pin holes 74 and 76 in the wall of the downstream section 36. The pivot axis of the plate 60 is the line between the pivot pins 70 and 72.

Referring now to FIG. 6, the plate 60 is mounted in the downstream section 36 so that the pivot axis of the plate 60 is off centre, most preferably approximately one-third of the distance from the central axis of the duct 24 and the wall of the duct 24. The plate 60 is mounted such that its pivot axis is in a plane substantially orthogonal to the central axis of the duct 24.

The plate 60 is pivotable between a closed position, shown in FIG. 6 by a solid line, and an open position, shown in FIG. 6 by a dotted line. The plate 60 is substantially elliptical and is thus shaped and sized so as to substantially block the duct 24 when in the closed position. The plate 60 is diagonally positioned within the duct 24 when in the closed position. When in the open position, the plate 60 allows gas to flow through the duct 24.

Preferably, the apparatus comprises a closed position stop means for allowing the plate 60 to rest at the closed position when gas under pressure is not flowing through the duct 24. The apparatus also preferably comprises open position stop means for stopping the plate 60 at the open position when the plate 60 is pivoted from the closed position to the open position.

The closed position stop means and the open position stop means may be any structure or structures that act on the plate 60 to allow it to rest in the closed position or to prevent further opening movement in the open position, including any other part of the apparatus already described. Most preferably, the plate 60 is mounted diagonally and positioned in the downstream section 36 so that the closed position stop means comprises the wall of the downstream section 36. It can now be appreciated that the elliptical shape of the valve allows it to closely engage the duct 24, by being sized and shaped to correspond with an angular plane passing through said duct. The open position stop means most preferably comprises the interior side 38 of the cover 26. The purpose of the open position stop means is to allow the plate 60 to pivot to the open position in the duct 24 while preventing it from reaching a position parallel to the central axis of the duct 24. Therefore, the plate 60 is most preferably mounted sufficiently close to the cover 26 to allow the cover 26 to act as the open position stop means.

The plate 60 is weighted such that, when the duct 24 is oriented in place, the plate 60 is biased by gravity to its closed position, and may be moved to the open position by gases flowing to the external environment through the duct 24 at a predetermined pressure. In this sense, in place means orienting the duct 24 substantially vertically, above a soffit, for example, but also comprehends orienting the duct 24 substantially horizontally to pass through a generally vertical wall. In the preferred embodiment, the counterweight 68 mounted on the short arm 64 produces a torque on the plate 60 about the pivot axis of the plate 60, thus causing the plate 60 to rest at its closed position. When gas under pressure flows through the duct 24, the gas exerts pressure both on the short arm 64 and the long arm 66 of the plate 60. Because the surface area of the long arm 66 is larger than that of the short arm 64, at a predetermined pressure (which is preferably small) the torque created by the force of the gas on the long arm 66 will be greater than the sum of the torques created by the counterweight and the force of the gas on the short arm 64. As result, the plate 60 will pivot from its closed position to its open position.

The open position stop means will then operate to keep the plate 60 in the open position by preventing the plate from overbalancing and potentially getting stuck in a substantially open position. In the preferred embodiment, this involves keeping the counterweight 68 from reaching a point directly above the pivot axis of the plate 60. If the counterweight 68 were to reach that point, then the plate 60 would rotate past the open position and remain in a semi-open position even after the air flow ceases. This is undesirable, and thus the flapper valve within the duct is configured to rotate with a maximum permitted degree of angular rotation of less than 90°.

The counterweight 68 is preferably small and of dense material, such as a steel ball bearing releasably attachable to the plate 60. The counterweight 68 is carried in a hole in the plate 60, and is held in place on one side by a counterweight barrier 76 and on the other by flexible forks 78 and 80. The counterweight 68 is inserted between the forks 78 and 80 and can be removed by pushing the counterweight 68 back out through the forks 78 and 80. In this manner it is easy and inexpensive to assemble.

Figure 7:
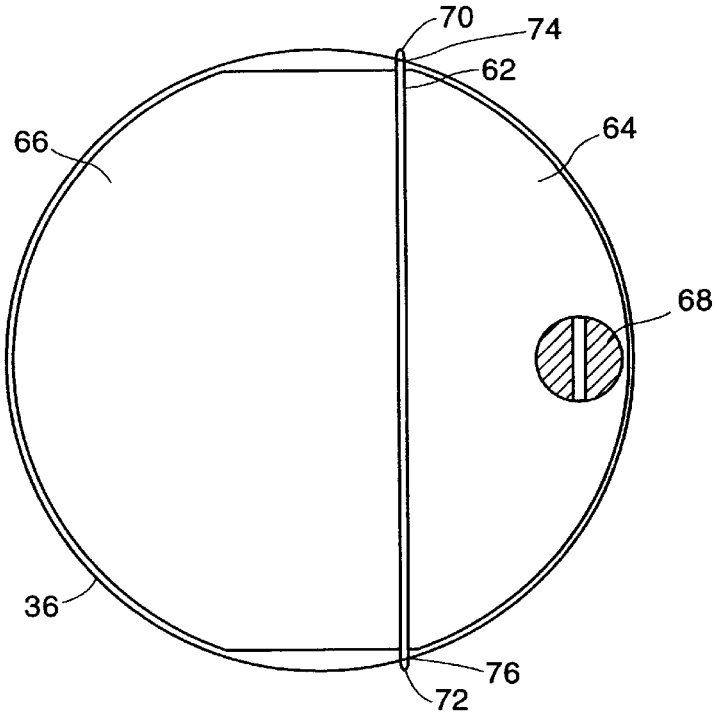
FIG. 7 is a plan view of the duct, showing the valve in the its closed position.

Referring now to FIG. 7, the downstream section 36 is shown in plan view with the plate 60 in the closed position. The downstream section 36 is substantially blocked.

Figure 8:
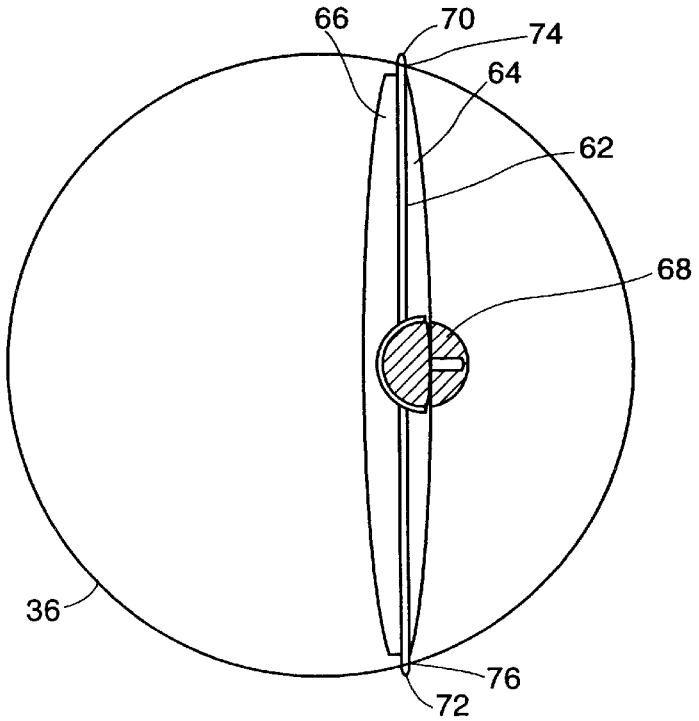
FIG. 8 is a plan view of the duct, showing the valve in its open position.

Referring now to FIG. 8, the downstream section 36 is shown in plan view with the plate 60 in the open position. The downstream section 36 is substantially open so as to allow gas to flow through the duct 24.

In operation, the duct 24 with the valve 58 mounted therein is attached to a gas conduit. The gas conduit is any means for allowing gas flow between an enclosure to be vented, and typically includes a device such as a fan for placing gases under pressure to actively vent them to the external environment.

The downstream end of the duct 24 is then threaded through an aperture in a soffit and mounted to the cover 26. The cover 26 is mounted to the soffit. When gas under pressure flows downstream from the gas conduit to the duct 24, the valve 58 allows the gases to pass through to the external environment. At other times, the valve 58 is closed (due to gravity) and prevents air from the external environment from flowing into the duct 24.

Figure 9:
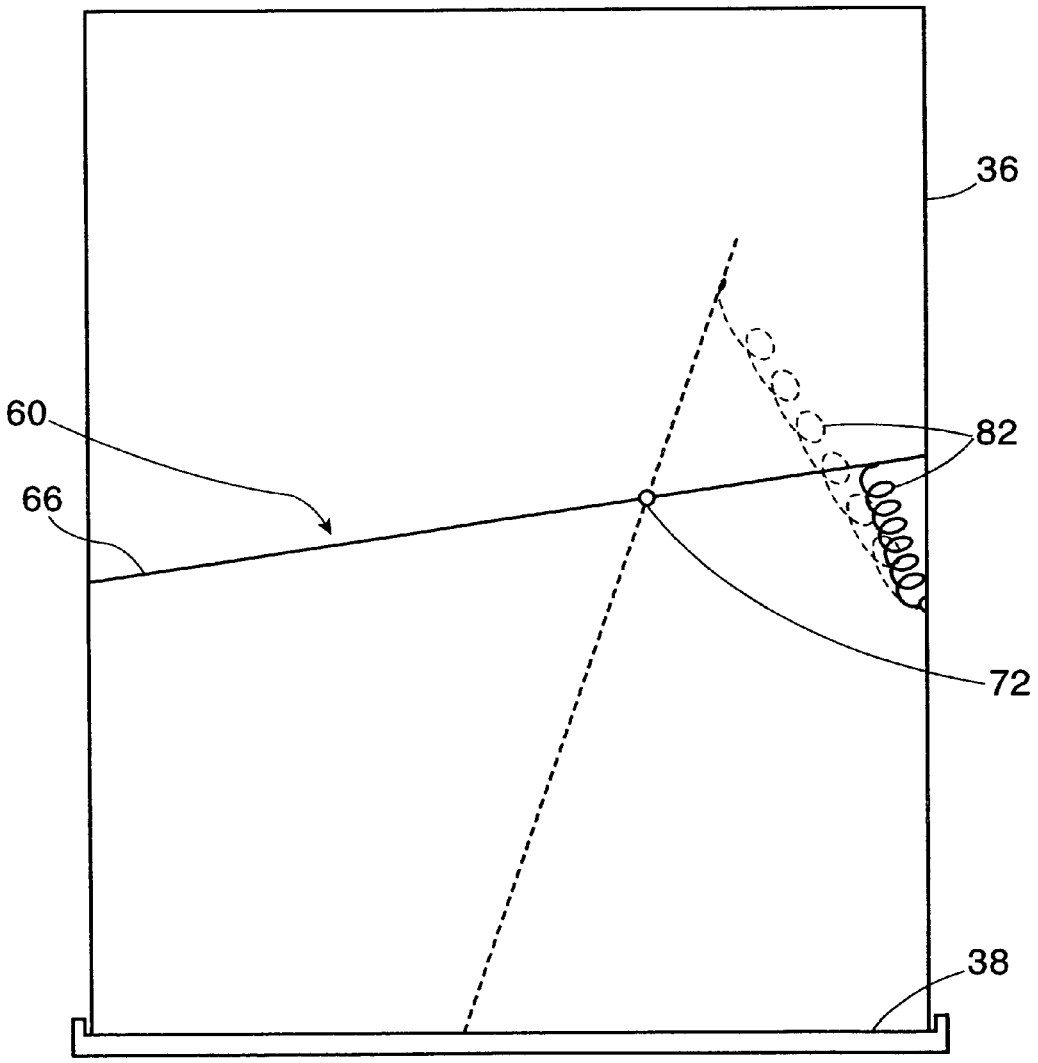
FIG. 9 is a cross-sectional view of an alternate embodiment of the soffit vent apparatus.

Referring now to FIG. 9, an alternate embodiment is shown in which the valve 58 is biased to its closed position by a spring biasing means in the form of a coil spring 82 attached at one end to the downstream section 36 and at the other end to the plate 60. The coil spring 82 exerts a pulling force which pulls the plate 60 to the downstream section 26, thus biasing the valve 58 to its closed position. However, the force exerted by the spring 82 is sufficiently small such that the valve 58 may be opened by gases under pressure flowing through the duct 24 to the external environment. It will be appreciated by those skilled in the art that the spring biasing means need not be in the form of a coil spring 82 connected between the edge of the plate 60 and the downstream section 36. Rather, the spring biasing means may comprise any spring mechanism which biases the valve 58 to the closed position. This would include, for example, a spring integrated into the hinge axis of the plate 60, or a spring mounted on the opposite side of the plate 60.

It will be further appreciated by those skilled in the art that the biasing to the closed position need not be done by means of gravity or springs in order to prevent the backflow of air from the external environment. Any means of biasing, including, for example, the use of magnets, is adequate, as long as the valve 58 is biased to its closed position and may be opened by gases under pressure flowing through the duct 24 to the external environment.

While the foregoing embodiments of the present invention have been set forth in considerable detail for the purposes of making complete disclosure of the invention, it will be apparent to those skilled in the art that various modifications can be made to the device without departing from the scope of the invention as defined in the attached claims. Some of these variations are discussed above and others will be apparent to those skilled in the art. For example, the mounting flange may include anything that achieves the result of making the cover mountable to a soffit without being outside the scope of the invention. Similarly, the wooden soffit mounting means and metal soffit mounting means may also comprise a glueable surface, nail holes, or any other feature which assists in mounting the cover to a wooden soffit or metal soffit respectively. What is considered important in the present invention is to provide a simple vent apparatus which allows pressurized gases to be vented while preventing back flow and not requiring an unsightly protrusion from the wall or soffit into which the vent apparatus is mounted. Preferably, the apparatus will be attachable to gas conduits of a plurality of different sizes.

The Embodiments of the Invention in Which an Exclusive Property or privilege is claimed are defined as follows:

1. A soffit vent apparatus for venting gases from an enclosure to the external environment, comprising:

a cover comprising an air-permeable portion and a mounting flange, said cover being mountable to a soffit;

a duct mountable to said cover in communication with said air-permeable portion and operatively coupleable to said enclosure;

a valve mounted in said duct;

wherein said valve allows gases under pressure to flow through said duct and said air-permeable portion to said external environment.

2. The soffit vent apparatus of claim 1 wherein said duct is snappably mountable to said cover.

3. The soffit vent apparatus of claim 1, said cover further comprising plastic-or-metal-soffit-mounting means and wooden-soffit mounting means.

4. A soffit vent apparatus for venting gases from an enclosure to the external environment, comprising:

a cover comprising an air-permeable portion and a mounting flange, said cover being mountable to a soffit;

a duct mountable to said cover in communication with said air-permeable portion and operatively coupleable to said enclosure; and a valve mounted in said duct. said valve having a closed position and being biased to said closed position, wherein said valve may be opened by gases under pressure flowing through said duct to said external environment.

5. The soffit vent apparatus of claim 4 wherein said valve is biased to said closed position by gravity.

6. The soffit vent apparatus of claim 4 wherein said valve is biased to said closed position by a spring biasing means.

7. The soffit vent apparatus of claim 4 wherein said valve comprises:

a valve barrier pivotally mounted in said duct, said valve barrier being pivotable between a closed position and an open position, said valve barrier being shaped so as to substantially block said duct when in the closed position and so as to allow gas flow through the duct when in the open position;

said valve barrier being weighted and shaped such that, when said duct is oriented in place, said valve barrier rests in said closed position, and moves to said open position when gas is vented to the external environment through the duct at a predetermined pressure;

whereby said valve prevents back flow of gas into the vented enclosure, but allows pressurized gas to be vented through the duct to the external environment.

8. The soffit vent apparatus of claim 5 wherein said valve comprises:

a valve barrier pivotally mounted in said duct, said valve barrier being pivotable between a closed position and an open position, said valve barrier being shaped so as to substantially block said duct when in the closed position and so as to allow gas flow through the duct when in the open position;

said valve barrier being biased to said closed position by a spring biasing means, wherein said valve barrier may be pivoted to said open position by gases under pressure flowing through said duct;

whereby said valve prevents back flow of gas into the vented enclosure, but allows pressurized gas to be vented through the duct to the external environment.

9. The soffit vent apparatus of claim 7:

said duct being substantially circular in cross-section;

said valve barrier comprising a substantially elliptical plate having a short arm and a long arm and a counterweight attached to said short arm;

said elliptical plate being diagonally positioned within said duct when in said closed position.

10. The soffit vent apparatus of claim 8:

said duct being substantially circular in cross-section;

said valve barrier comprising a substantially elliptical plate being diagonally positioned within said duct when in said closed position.

11. The soffit vent apparatus of claim 7, further comprising a closed position stop means for allowing said valve barrier to rest at said closed position.

12. The soffit vent apparatus of claim 8, further comprising a closed position stop means for allowing said valve barrier to rest at said closed position.

13. The soffit vent apparatus of claim 11 wherein said apparatus further comprises open position stop means for stopping said valve barrier at said open position when said valve barrier is pivoted from said closed position.

14. The soffit vent apparatus of claim 12 wherein said apparatus further comprises open position stop means for stopping said valve barrier at said open position when said valve barrier is pivoted from said closed position.

15. The soffit vent apparatus of claim 11 wherein said closed position stop means comprises the wall of said duct.

16. The soffit vent apparatus of claim 12 wherein said closed position stop means comprises the wall of said duct.

17. The soffit vent apparatus of claim 13 wherein said closed position stop means comprises the wall of said duct, and said open position stop means comprises said cover.

18. The soffit vent apparatus of claim 14 wherein said closed position stop means comprises the wall of said duct, and said open position stop means comprises said cover.

19. The soffit vent apparatus of claim 1 wherein said soffit vent apparatus further comprises a conduit size adaption means, whereby said duct may be adapted to operatively communicate with different conduits having a plurality of different diameters.

20. The soffit vent apparatus of claims said cover further comprising plastic-or-metal-soffit-mounting means and wooden-soffit mounting means.

21. A soffit vent apparatus for venting gases from an enclosure to the external environment, comprising:

a cover comprising an air-permeable portion and a mounting flange, said cover being mountable to a soffit;

a duct, substantially circular in cross-section, comprising an upstream section and a downstream section, said upstream section being of smaller cross-sectional area then said downstream section and in operative communication therewith, said duct being mountable to said cover in communication with said air-permeable portion and operatively coupleable to said enclosure;

conduit size adaption means comprising said upstream section and said downstream section in combination;

a valve mounted in said duct, said valve comprising a valve barrier comprising a substantially elliptical plate pivotally mounted in said downstream section, said plate being pivotable between a closed position and an open position, said plate being diagonally positioned within said downstream section in said closed position and shaped so as to substantially block said downstream section when in said closed position and so as to allow gas to flow through said downstream section when in the open position, said plate having a short arm and a long arm and a counterweight attached to said short arm, said plate being weighted such that when the duct is oriented substantially vertically the plate is biased to said closed position by gravity and may be moved to said open position by gases at a predetermined pressure flowing to the external environment through the duct;

closed position stop means comprising the wall of said duct for allowing said plate to rest at said closed position;

open position stop means comprising said cover for stopping said plate at said open position.

22. The soffit vent apparatus of claim 21 wherein said duct is snappably mountable to said cover.

23. The soffit vent apparatus of claim 22, further comprising a lip adjacent to the downstream edge of said duct and a plurality of lip clamps positioned on said cover so as to be clampable on said lip.

24. The soffit vent apparatus of claim 21 wherein said upstream section and downstream section are substantially co-axial and cylindrical.

25. The soffit vent apparatus of claim 23, said cover further comprising plastic-or-metal-soffit-mounting means and wooden-soffit mounting means.

26. A soffit vent apparatus for venting gases from an enclosure to the external environment, comprising:

a cover comprising an air-permeable portion and a mounting flange, said cover being mountable to a soffit, said cover further comprising wooden-soffit-mounting means and plastic-or-metal-soffit-mounting means;

a duct snappably mountable to said cover in communication with said air-permeable portion and operatively coupleable to said enclosure, said duct comprising an upstream section and downstream section, said upstream section being of smaller cross-sectional area than said downstream section, said upstream section and downstream section being substantially cylindrical and co-axial;

a lip adjacent to the downstream edge of said duct, and a plurality of lip clamps attached to said cover and positioned so as to be clampable on said lip;

conduit size adaption means comprising said upstream section and said downstream section in combination;

a valve mounted in said duct comprising a valve barrier comprising a substantially elliptical plate pivotally mounted in said downstream section, said plate being pivotable between a closed position and an open position, said plate being diagonally positioned within said downstream section in said closed position and shaped so as to substantially block said downstream section when in the closed position and so as to allow gas to flow through said downstream section when in the open position, said plate having a short arm and a long arm and a counterweight attached to said short arm, said plate being weighted such that when the duct is oriented substantially vertically the plate is biased to said closed position by gravity and may be moved to said open position by gases under a predetermined pressure flowing to the external environment through the duct;

closed position stop means for allowing said plate to rest at said closed position, comprising the wall of said duct;

open position stop means for stopping said plate at said open position, comprising said cover.

* * * * *